US006419335B1

(12) United States Patent
Gooray et al.

(10) Patent No.: US 6,419,335 B1
(45) Date of Patent: Jul. 16, 2002

(54) ELECTRONIC DRIVE SYSTEMS AND METHODS

(75) Inventors: Arthur M. Gooray; George J. Roller, both of Penfield, NY (US); Joseph M. Crowley, Morgan Hill, CA (US); Paul C. Galambos; Frank J. Peter, both of Albuquerque, NM (US); Kevin R. Zavadil, Bernilillo, NM (US); Richard C. Givler, Albuquerque, NM (US); William M. Lindenfelser, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 7 days.

(21) Appl. No.: 09/718,480

(22) Filed: Nov. 24, 2000

(51) Int. Cl.[7] ..... B41J 29/38; B41J 2/04
(52) U.S. Cl. ..... 347/9; 347/10; 347/54
(58) Field of Search ..... 347/9, 54

(56) References Cited

U.S. PATENT DOCUMENTS

| | | | | |
|---|---|---|---|---|
| 4,520,375 | A | 5/1985 | Kroll | 347/54 |
| 5,501,893 | A | 3/1996 | Laermer et al. | 428/161 |
| 5,668,579 | A | 9/1997 | Fujii et al. | 347/10 |
| 5,754,205 | A | 5/1998 | Miyata et al. | 347/20 |
| 5,783,340 | A | 7/1998 | Farino et al. | 430/22 |
| 5,798,283 | A | 8/1998 | Montague et al. | 438/24 |
| 5,804,084 | A | 9/1998 | Nasby et al. | 216/2 |
| 5,821,951 | A | 10/1998 | Fujii et al. | 347/10 |
| 5,828,394 | A | 10/1998 | Khuri-Yakub et al. | 347/72 |
| 5,919,548 | A | 7/1999 | Barron et al. | 438/128 |
| 5,963,788 | A | 10/1999 | Barron et al. | 438/48 |
| 6,082,208 | A | 7/2000 | Rodgers et al. | 74/406 |
| 6,127,198 | A | 10/2000 | Coleman et al. | 438/21 |
| 6,322,198 | B1 * | 11/2001 | Higashino et al. | 347/54 |

* cited by examiner

*Primary Examiner*—John Barlow
*Assistant Examiner*—Alfred Dudding
(74) *Attorney, Agent, or Firm*—Oliff & Berridge, PLC

(57) ABSTRACT

An electronic drive system applies a drive signal to an electrostatically actuated device such that a resulting electric field has a constant force. In various exemplary embodiments, the electronic drive system applies a drive signal to an electrostatically actuated fluid ejector that has a piston and a faceplate including a nozzle hole. A dielectric fluid to be ejected is supplied between the piston and the faceplate. The drive signal is applied to one of the piston and the faceplate. The drive signal generates an electric field across the fluid between the piston and the faceplate. The electric field causes the piston to be electrostatically attracted towards the faceplate so that a jet or drop of fluid is ejected through the nozzle hole of the faceplate. According to exemplary embodiments, the drive signal is from a constant current source or is reduced over the course of its lifetime. Further, according to various exemplary embodiments, the drive signal is of a suitable high frequency to reduce the potential of electrochemical reactions or electrical breakdown, or both. The drive signal may also be a bi-polar drive signal to reduce the possibility of electrochemical reactions.

19 Claims, 6 Drawing Sheets

FIG. 1
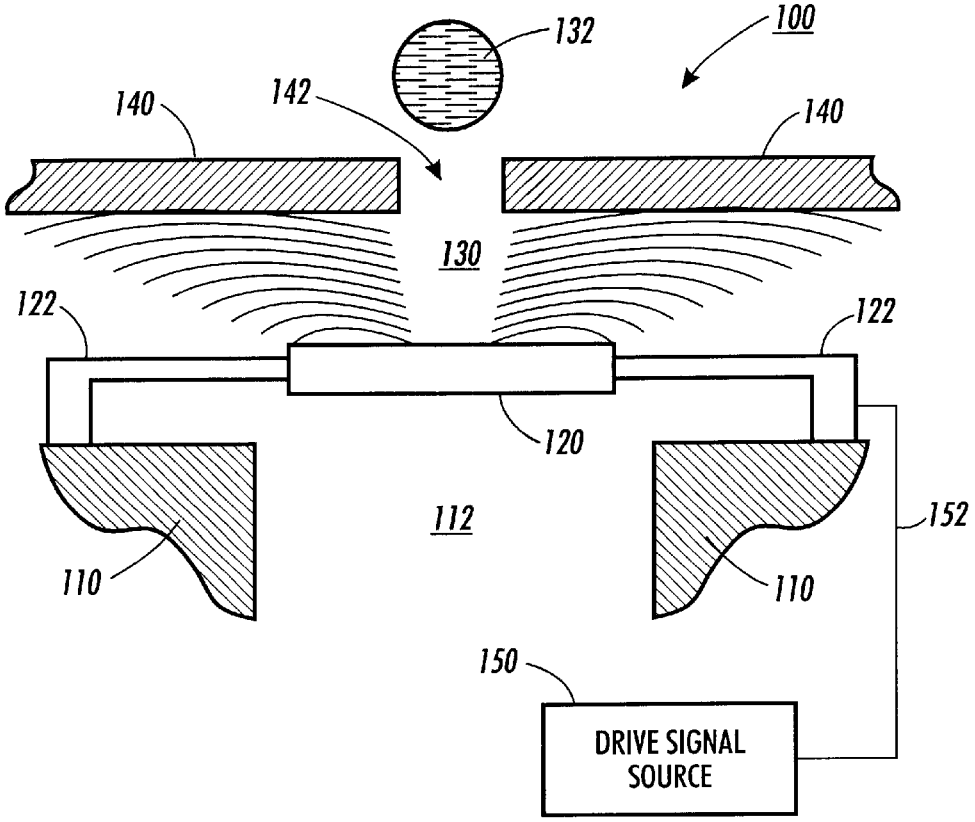
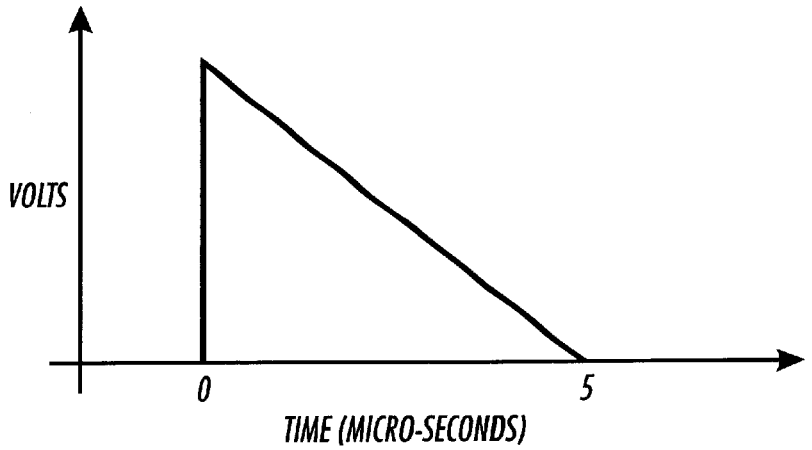
FIG. 2

FIG. 5
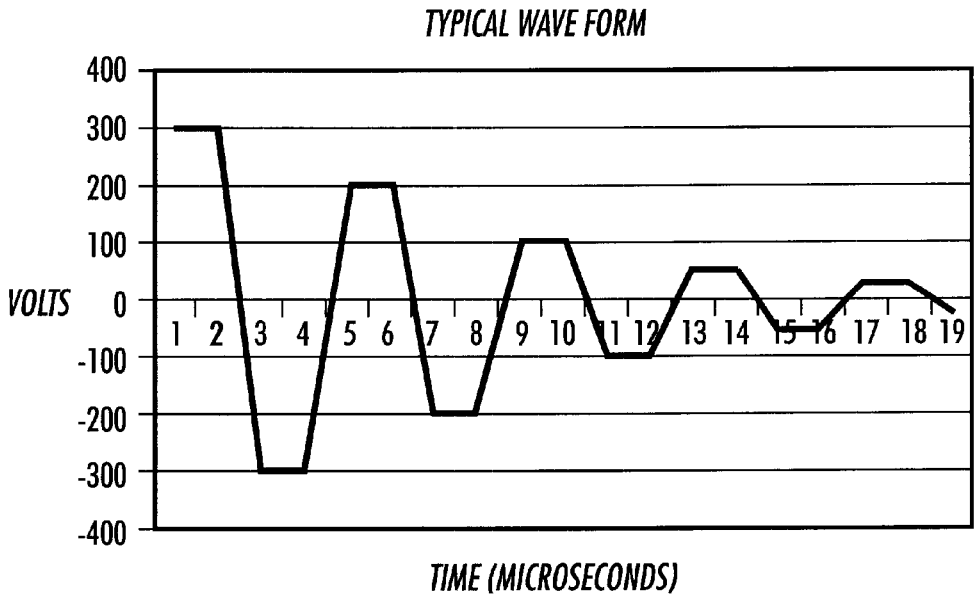
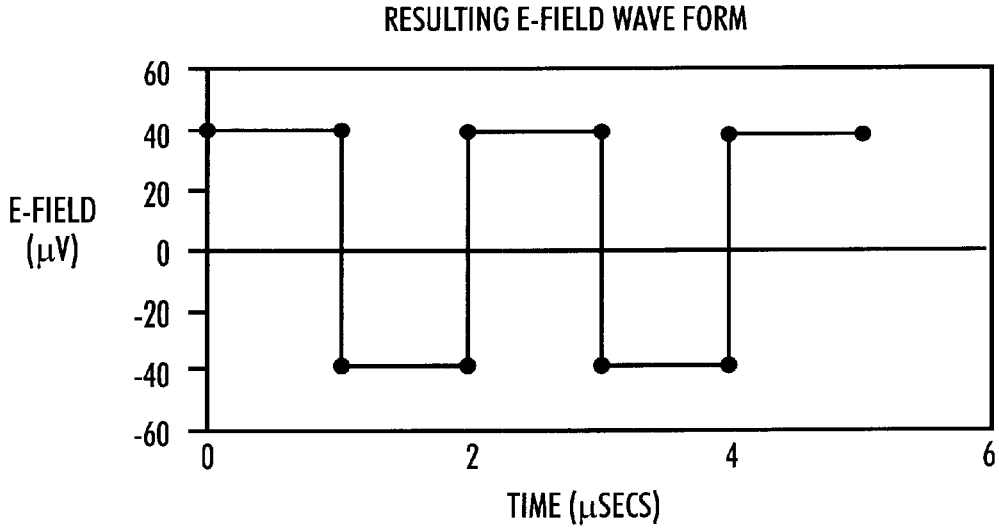
FIG. 6

ELECTRONIC DRIVE SYSTEMS AND METHODS

BACKGROUND OF THE INVENTION

1. Filed of the Invention

This invention relates to systems and methods for driving an electrostatically actuated device using an electronic drive signal.

2. Description of the Related Art

One type of electrostatically actuated device with which the systems and methods of this invention may be used is micromachined fluid ejectors. Fluid ejectors have been developed for ink jet recording or printing, as well as other uses. Ink jet recording apparatus offer numerous benefits, including extremely quiet operation when recording, high speed printing, a high degree of freedom in ink selection, and the ability to use low-cost plain paper. The so-called "drop-on-demand" drive method, where ink is output only when required for recording, is now the conventional approach. The drop-on-demand drive method makes it unnecessary to recover ink not needed for recording.

Fluid ejectors, including those used for ink jet printing, include one or more nozzles that allow the formation and control of small ink droplets to permit high resolution, resulting in the ability to print sharper characters with improved tonal resolution. In particular, drop-on-demand ink jet print heads are generally used for high resolution printers.

Drop-on-demand technology generally uses some type of pulse generator to form and eject drops. For example, in one type of print head, a chamber having an ink nozzle may be fitted with a piezoelectric wall that is deformed when a voltage is applied. As a result of the deformation, the fluid is forced out of the nozzle orifice as a drop. The drop then impinges directly on an associated printing surface. Use of such a piezoelectric device as a driver is described in JP B-1990-51734.

Another type of print head uses bubbles formed by heat pulses to force fluid out of the nozzle. The drops are separated from the ink supply when the bubbles form. Use of pressure generated by heating the ink to generate bubbles is described in JP B-1986-59911.

Yet another type of drop-on-demand print head incorporates an electrostatic actuator. This type of print head utilizes electrostatic force to eject the ink. Examples of such electrostatic print heads are disclosed in U.S. Pat. No. 4,520,375 to Kroll and Japanese Laid-Open Patent Publication No. 289351/90. The ink jet head disclosed in the 375 patent uses an electrostatic actuator comprising a diaphragm that constitutes a part of an ink ejection chamber and a base plate disposed outside of the ink ejection chamber opposite to the diaphragm. The ink jet head ejects ink droplets, through a nozzle communicating with the ink ejection chamber, by applying a time-varying voltage between the diaphragm and the base plate. The diaphragm and the base plate thus act as a capacitor, which causes the diaphragm to be set into mechanical motion and the fluid to exit responsive to the diaphragm's motion.

On the other hand, the ink jet head discussed in the Japan 351 distorts its diaphragm by applying a voltage to an electrostatic actuator fixed on the diaphragm. This result in suction of ink into an ink ejection chamber. Once the voltage is removed, the diaphragm is restored to its non-distorted condition, ejecting ink from the ink over-filled ejection chamber.

Fluid drop ejectors may be used not only for printing, but also for depositing photoresist and other liquids in the semiconductor and flat panel display industries, for delivering drug and biological samples, for delivering multiple chemicals for chemical reactions, for handling DNA sequences, for delivering drugs and biological materials for interaction studies and assaying, and for depositing thin and narrow layers of plastics for usable as permanent and/or removable gaskets in micro-machines.

SUMMARY OF THE INVENTION

This invention provides systems and methods that allow efficient actuation of electrostatically driven devices.

This invention separately provides systems and methods for electrostatic actuation using a constant electric field force.

This invention separately provides systems and methods that generate increased ejection force for electrostatically actuated fluid ejectors.

This invention separately provides systems and methods for electrostatic actuation in which potential electrochemical reactions are reduced.

This invention separately provides systems and methods for electrostatic actuation in which conductivity losses are reduced.

This invention separately provides systems and methods for electrostatic actuation in which the potential for dielectric breakdown is reduced.

This invention separately provides systems and methods for "on demand" drop size modulation for electrostatically actuated fluid ejectors.

In various exemplary embodiments of the systems and methods according to this invention, a drive signal is applied to an electrostatically actuated device, such that a resulting electric field has a constant force. In various exemplary embodiments, the drive signal may applied by a constant current source. Alternatively, in various other exemplary embodiments, the drive signal may be reduced over the course of its lifetime.

In various exemplary embodiments of the systems and methods according to this invention, an electrostatically actuated device is driven at a rate that reduces the potential effects of electrochemical reactions.

In various exemplary embodiments of the systems and methods according to this invention, a bi-polar drive signal is applied to an electrostatically actuated device such that the potential effects of electrochemical reactions are reduced.

In various exemplary embodiments of the systems and methods according to this invention, a drive signal of a suitably high frequency is applied to an electrostatically actuated device such that the potential of electrochemical reactions or electrical breakdown, or both, is reduced.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention described in detail below, with reference to the attached drawing figures, in which:

FIG. 1 is a cross-sectional view of an exemplary embodiment of a single fluid ejector that is electrostatically driven according to this invention;

FIG. 2 is a plot qualitatively illustrating an exemplary drive signal according to this invention;

FIG. 5 is a plot illustrating a bi-polar pulse train waveform of an exemplary drive signal according to this invention;

FIG. 6 is a plot qualitatively illustrating an exemplary constant strength electric field generated by the bi-polar pulse train of FIG. 5;

DETAILED DESCRIPTION OF EXEMPLARY EMBODIMENTS

Figure 3:
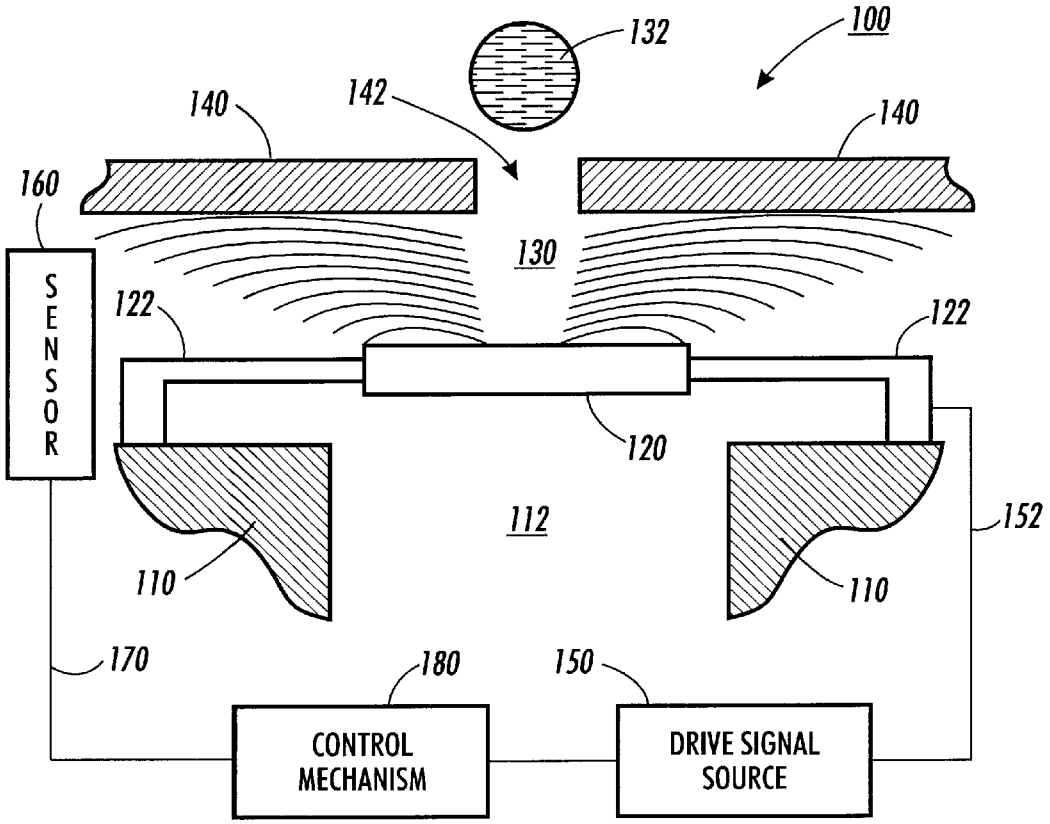
FIG. 3 is a cross-sectional view of an exemplary embodiment of a single fluid ejector according to this invention including a position sensor.

The systems and methods of this invention will be described below with reference to an electrostatically actuated fluid ejector as described in copending U.S. patent application Ser. Nos. 09/718,420 and 09/722,331, each of which is incorporated herein by reference in its entirety. It should be understood, however, that the systems and methods of this invention may be applied to a wide variety of devices other than the specific embodiment of the fluid ejector discussed below or fluid ejectors in general.

In various exemplary embodiments of the systems and methods according to this invention, a drive signal is applied to an electrostatically actuated device such that a resulting electric field has a constant force. For example, in an electrostatically actuated fluid ejector, the drive signal is applied to one of a piston and a faceplate including a nozzle hole. A dielectric fluid to be ejected is supplied between the piston and the faceplate. The drive signal generates an electric field across the fluid between the piston and the faceplate. The electric field causes the piston to be electrostatically attracted towards the faceplate so that a jet or drop of fluid is ejected through the nozzle hole of the faceplate. The electric field will have a constant force if the drive signal is from a constant current source or if the drive signal is reduced over the course of one drive pulse.

Various embodiments of the systems and methods of this invention use a bipolar drive signal. Thus, in various exemplary embodiments, a bi-polar pulse train at a desired frequency is applied to reduce the possibility of electrochemical reactions. A bi-polar drive signal causes the potential at the electrode surface to be periodically reversed. This reversal causes the electrode to act as an anode during a portion of the time the drive signal is applied and as a cathode during a portion of the time the drive signal is applied. Since anodic reactions and cathodic reactions result in different electrochemical products, the concentration of a particular electrochemical product is reduced by interrupting the corresponding reaction and allowing the electrochemical product to diffuse to the fluid. This reduces the possibility of exceeding the saturation concentration limit of any electrochemical reaction product in the fluid. As noted above, if the saturation concentration limit of any electrochemical reaction is exceeded, sufficient thermodynamic driving force exists for gas nucleation and bubble formation.

Electrochemical reactions can also be minimized by reducing the amount of time the driving electrostatic field is applied. In various embodiments of the systems and methods of this invention, the time required to drive the fluid ejector is decreased to reduce the time for the electrochemical reaction(s) to occur. Hence, the undesired bubble formation and other undesirable reactions are reduced. In other words, the amount of undesired bubble formation is proportional amount of time the driving electrostatic field is applied. Thus, by reducing the length of the drive signal, less electrochemical reactions occur.

In various other exemplary embodiments, using a drive signal of a suitably high frequency will reduce the potential of electrochemical reactions or electrical breakdown, or both. The dielectric and electrochemical breakdown thresholds of fluids have been experimentally shown to be related to the frequency of an applied signal. A higher frequency signal increases the threshold at which dielectric breakdown of the fluid will occur. For example, for a particular aqueous-based fluid, a ten-fold increase in the frequency of the signal may increase the dielectric breakdown threshold by more than a factor of two. Using of a higher frequency signal also helps reduce undesirable electrochemical reactions within the fluid, such as, for example, electrolytic decomposition of water.

Electrolytic decomposition of water will occur with as little as 1.23 V applied between two polarized plates, under ideal conditions. A cathodic reaction occurs at the electrode biased or fixed at the more negative relative potential to produce hydrogen gas. An anodic reaction occurs at the electrode biased or fixed at the more positive relative potential to produce oxygen gas. Electrolysis thus introduces the possibility of gas evolution and partial depolarization of the electrodes.

For example, gas bubbles can nucleate and grow in a fluid ejector if a critical saturation of either hydrogen or oxygen in the fluid is exceeded. The gas bubbles can then impact the dynamics of drop ejection from the fluid ejector. Smaller bubbles in the fluid are unstable and collapse, thus releasing relatively large amounts of energy locally by cavitation. This may lead to erosion, such as pitting, of polysilicon elements within the fluid ejector. This may also cause electrode depolarization, resulting in a lower steady state potential to be applied to the electrodes and a reduced electrostatic field. As current is drawn by the electrolysis reactions, increased offsetting currents are required to maintain the desired electrostatic field. Thus, the efficiency of the fluid ejector is decreased. Larger bubbles, on the other hand, may actually impede drop ejection by displacing the fluid away form the nozzle(s) or adversely affecting the fluid dynamics of the fluid ejector. Similarly, larger bubbles may negatively impact fluid refill. The existence of larger bubbles also risks lowering of the fluid breakdown field strength below that required to eject a drop of the fluid.

Other electrochemical reactions are also possible with similar consequences. For example, dye molecules of an ink that contain complexed or chelated metal cations, including organometallics, will show electrochemical reduction or oxidation chemistry at potentials typically required to drive a micromachined fluid ejector. Organic compounds known to be electrochemically active, for example, include hydrocarbon, halogenated hydrocarbon, nitro, amine, saturated carbonyl, unsaturated carbonyl, carboxylate, phenolic, hydroxy, sulfide, thiocarbonyl and heterocyclic compounds. If the fluid has high concentrations of additives, such as, for example, the additives listed above, electropolymerization may occur, coating internal surfaces of the fluid ejector with the polymerized material.

FIG. 1 shows, by way of example only, an embodiment of an electrostatically-actuated fluid ejector 100. The electrostatically-actuated fluid ejector 100 comprises an unsealed piston 120 supported by one or more spring elements 122 connected to a substrate 110 at one side of the piston 120. A faceplate 140, including at least one ejector nozzle 142, is formed at the other side of the piston 120. A fluid bath 130 is disposed between the face plate 140 and the substrate 110. The fluid bath 130 communicates with a fluid supply (not shown) through a fluid feed 112 formed in the substrate 110.

The electrostatically-actuated fluid ejector 100 is actuated electrostatically when a drive signal 152 from a drive signal source 150 applied so that an electrostatic field E is generated between the piston 120 and the faceplate 140 across a fluid in the fluid bath 130. For example, a voltage may be applied to the piston 120 while the faceplate 140 is kept at ground potential. This potential difference between the faceplate 140 and the piston 120 generates the electrostatic field E across the fluid in the fluid bath 130. The electrostatic field E produces an electrostatic attractive force that pulls the piston 120 towards the faceplate 140. Movement of the piston 120 forces a drop 132 out of the ejector nozzle 142.

The drive signal 152 may be used to increase dielectric fluid breakdown latitude. In the regime of very small dimensions that are typical of microelectromechanical system (MEMS) or micromachined devices such as fluid ejectors, the dielectric breakdown strength of a fluid often increases as the dimension critical to breakdown decreases. This property is dependent upon the fluid under consideration. For the following description, the dielectric breakdown strength is assumed to remain constant over the dimensions considered to simplify the description of the systems and methods according to this invention.

The drive signal 152 may also be applied to an electrode when the ejector includes a diaphragm, instead of the piston 120, as disclosed in copending U.S. patent application Ser. No. 09/718,476, which is incorporated herein by reference in its entirety. A dielectric fluid is contained between the electrode and the diaphragm.

In either case, the specific drive signal 152 used to power the piston 120 or diaphragm and drive the drop 132 out of the electrostatically-actuated fluid ejector 100 may in fact be any signal that is effective in this task. However, a constant electric field strength will help to improve device performance, especially when the electric field strength is at a maximum without dielectric breakdown of the fluid. In various embodiments, the systems and methods of this invention provide a constant electric field strength by directly reducing the an applied voltage or by driving the electrostatically-actuated fluid ejector 100 with a constant current source.

FIG. 2 illustrates a qualitative example of the drive signal 152 which may be used to deflect the piston 120 or a diaphragm and produce the drop 132. Such a drive signal will produce the constant electric field E across a gap between the piston 120 and the faceplate 140 or between the diaphragm and the electrode as the distance between the faceplate 140 and the piston 120 or the diaphragm and the electrode decreases linearly with time. The constant electric field E is applied for a length of time necessary to drive the drop 132 out of the ejector nozzle 142 or to "cock" the diaphragm. The electric field E is then shut off to allow the spring elements 122 to return the piston 120 to its rest position, or to allow a resilient spring force of the diaphragm to restore the diaphragm to its undeflected position, or to allow another applied force to restore the piston or diaphragm to its undeflected position. The essence of the approach according to this invention is maintaining a constant electrostatic field E throughout the ejection motion of the piston 120 or the "cocking" motion of the diaphragm.

In various embodiments of the systems and methods according to this invention, an applied voltage that varies as a function of piston/diaphragm displacement or deflection may be used to drive the piston 120 or diaphragm with the constant electric field E that has a strength below the strength of the breakdown field of the dielectric fluid. As shown in FIG. 3, a closed-loop control comprising a position sensor 160 or other sensing mechanism capable of detecting the piston/diaphragm displacement or deflection may be used. Thus, any known or later-developed sensing mechanism may be used, such as, for example, a light-based interferometer, an optical sensor or a capacitance sensor. A feedback mechanism 170 is included to communicate information from the position sensor 160 to a separate control mechanism 180, or to the drive signal source 150 itself, so that the drive signal 152 is controlled or varied directly as a function of the distance between the distance between the faceplate 140 and the piston 120 or the diaphragm and the electrode.

Figure 4:
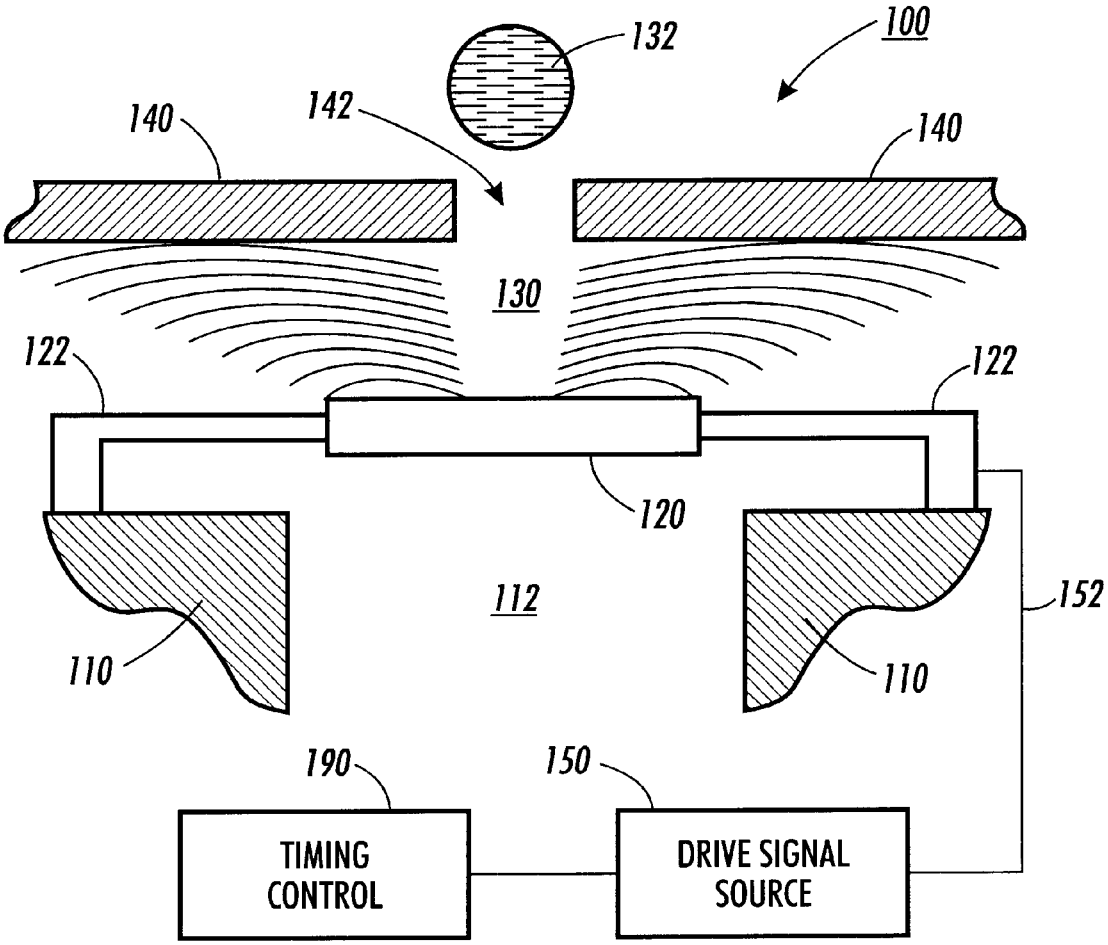
FIG. 4 is a cross-sectional view of an exemplary embodiment of a single fluid ejector according to this invention including a timing mechanism.

As shown in FIG. 4, a suitable timing control 190 may replace the position sensor 160 of FIG. 3 to provide an open loop-control. Thus, the drive signal 152 may be controlled or varied indirectly with distance through a time-based function. The timing control 190 thus provides a time-varying drive signal in accordance with the actual performance characteristics of the particular design of the fluid ejector 100. While the timing control 190 is shown as a separate element, it should be understood that the timing control 190 may be incorporated in the drive signal source itself.

For fluids with a dielectric breakdown strength that changes as the critical breakdown dimension changes, the drive signal 152 may be suitably tailored to maintain the maximum possible strength of the electric field E. That is, to minimize the chance of electrical breakdown or other electrochemical reactions occurring within the dielectric fluid, the drive signal 152 may be tailored to have certain specified characteristics. First, the electrostatically-actuated device may be driven at a suitable rate. Second, the drive signal may be applied for a suitable length of time. Third, the drive signal may be a bi-polar signal. Fourth, the drive signal may oscillate at a suitably high frequency.

The electrostatically-actuated device may be driven at a rate that allows any electrochemical reactions that occur to dissipate to reduce or avoid any adverse effects of these electrochemical reactions. For example, in a fluid ejector, the maximum rate of drop ejection is about 40 kHz. Thus, depending on the fluid refill rate of the fluid ejector, a drop of fluid can be ejected about once every 25 $\mu$s while reducing adverse effects of any electrochemical reactions.

Applying the drive signal for a shorter length of time reduces potential electrochemical reactions. For example, if a voltage is applied for less time, electrochemical reactions resulting from the applied voltage have less time to occur.

For example, in a fluid ejector, the minimum amount of time required to eject a drop of fluid is about 4 $\mu$s.

A bi-polar pulse train at the desired frequency may be used for the drive signal 152. An exemplary waveform is shown in FIG. 6. Due to the nature of electrochemical kinetics, a bi-polar voltage may be applied to minimize the possibility of electrochemical reactions, as described above. The magnitude of the effect of the bi-polar pulse train will depend on the specific fluid being used.

It has been demonstrated experimentally that the electrical breakdown threshold of fluids is related to frequency.

Specifically, higher frequency signals increase the threshold at which dielectric breakdown occurs by rapidly reversing the polarity of the signal to reduce the time available for an electrochemical reaction at each polarity. The actual relationship between the breakdown strength and the drive signal frequency is dependent upon the specific fluid being considered. For example, in a fluid ejector, during the approximately 4 $\mu$s that the drive signal is applied, the bi-polar pulse may be switched about every 0.2 $\mu$s.

Advantageously, the bi-polar pulse train has no effect on device operation, since the applied force due to the presence of the electric field E is dependent upon the square of the magnitude of the electric field. FIG. 6 illustrates an exemplary constant strength electric field that is generated by the bi-polar pulse train of FIG. 5.

Figure 7:
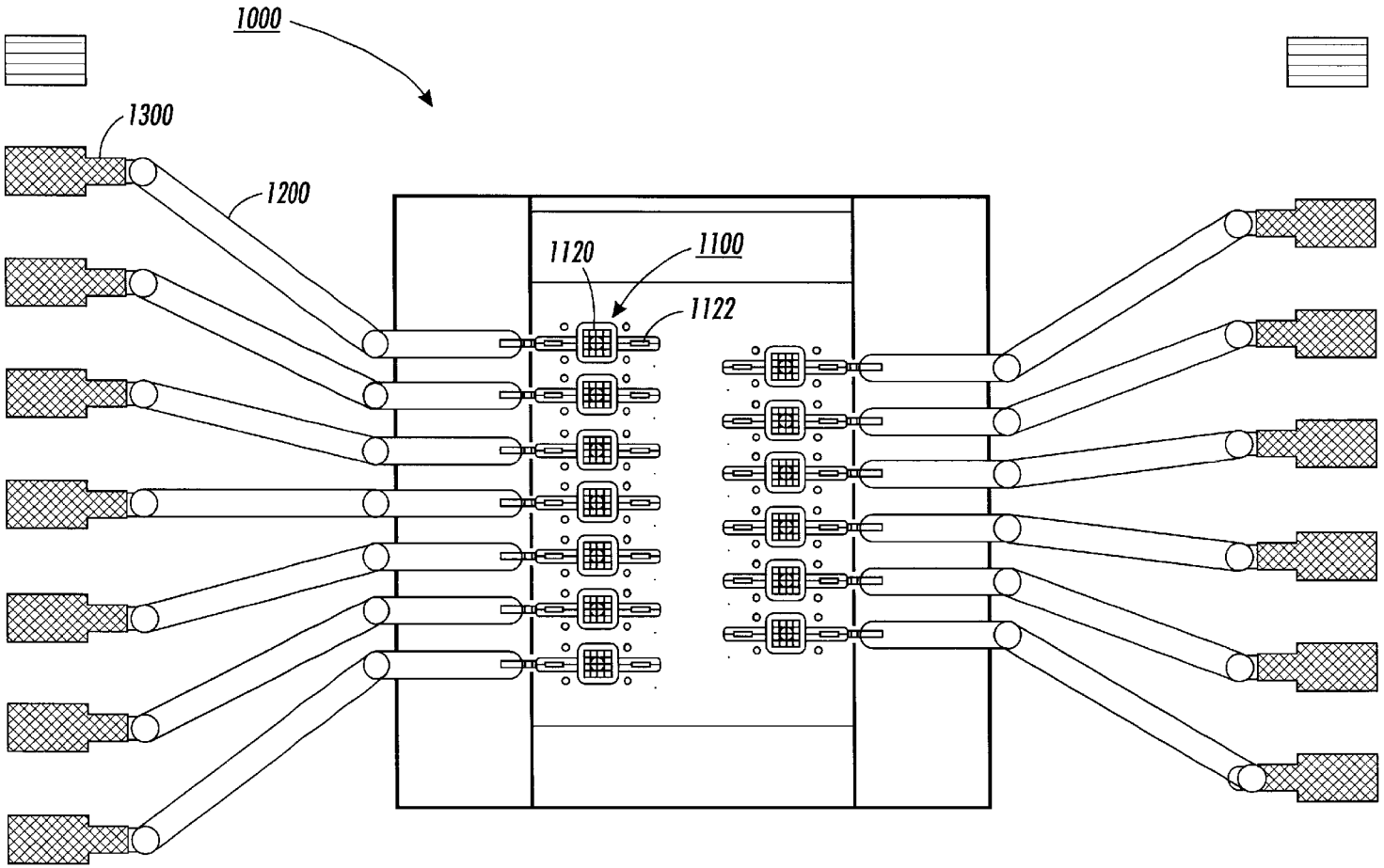
FIG. 7 is a top view of an exemplary embodiment of a print head assembly usable with this invention.

Electronics used to create the drive signal may be incorporated into a printed wiring board that is mechanically separated from a print head housing a plurality or array of fluid ejectors. In such a case, individual electrical leads must be supplied from the printed wiring board to each fluid ejector. FIG. 7 is a top view of one exemplary embodiment of a print head assembly 1000 utilizing this approach. Thirteen fluid ejectors 1100 are shown in the center. Each fluid ejector 1100 has a piston 1120 with spring elements 1122. Electrical traces 1200 from a plurality of bond pads 1300 at the edge of the print head assembly 1000 provide an insulated electrical path to each individual piston 1120 via the spring elements 1122. Of course, the print head assembly 1000 is for illustrative purposes only. Many modifications are possible, including different size arrays with different number of columns and rows than that shown.

Such an approach, however, has a limited packing density. Given the design rules governing implementations of the bond pads 1300, for example, such as minimum size and spacing constraints, a maximum packing density will be dictated in a large part by the resulting bond pad connection geometry to the individual fluid ejectors 1100. This may be a practical limitation on the size of the array that be created.

Figure 8:
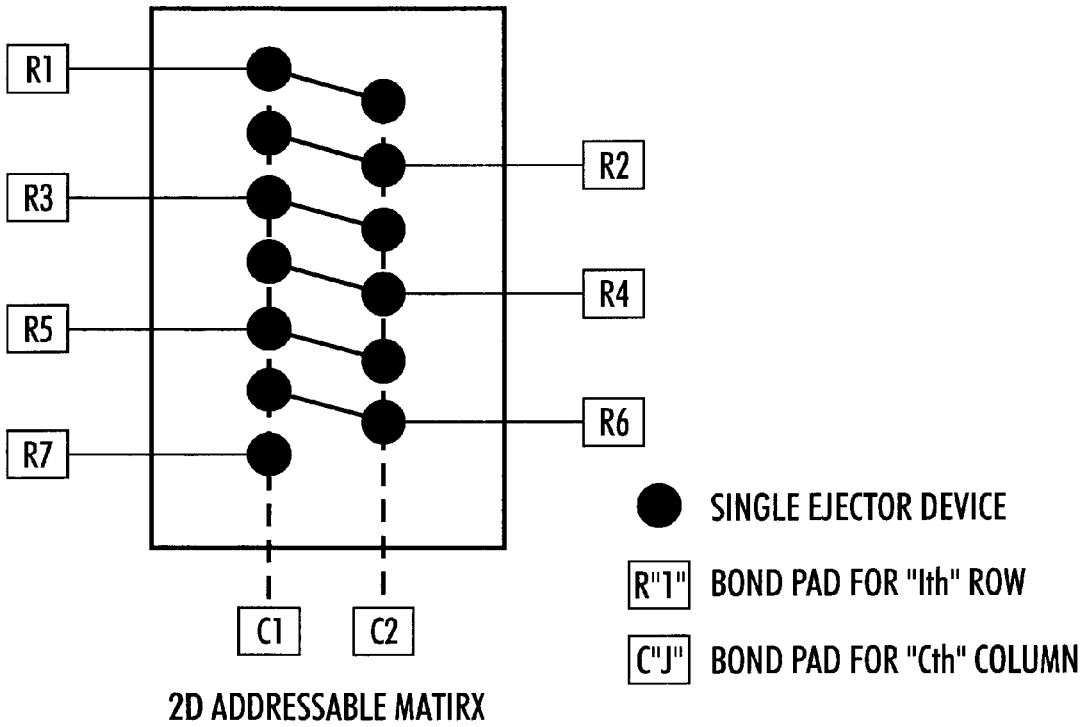
FIG. 8 illustrates a 2D matrix addressing technique for use with this invention.

An alternative approach is to utilize a 2D matrix addressing technique, as shown in FIG. 8. In this approach, there is one electrical "input" path per columns Cl and C2 and one electrical "output" path per rows RI, R2, R3 and R4. Each fluid ejector 1100 is controlled by the specific column and row that is addressed. This approach effectively halves the bond pad packing density so that the limitation in the previous approach is relieved to a large degree.

A third alternative is to incorporate a substantial part of the required control electronics into the print head rather than the printed wiring board. When construction of such a device is by silicon-based manufacturing techniques, the electronics may be fabricated on the same silicon chip as the print head in an integrated process, such as the IMEMS process of Sandia National Labs. The IMEMS process is described in U.S. Pat. No. 5,783,340 to Farino et. al., U.S. Pat. No. 5,798,283 to Montague et. al., U.S. Pat. No. 5,919,548 to Barron et. al. and U.S. Pat. No. 5,963,788 to Barron et. al., each of which is incorporated herein by reference in its entirety. In this case, there are a minimum number of connections to control functions residing on the external printed wiring board, since the electronics controlling the addressing and firing of the individual fluid ejectors 1100 are built into the silicon base.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. An electronic drive method for an electrostatically actuated device having a first electrode on a first part and a second electrode on a second part that is displaceable relative to the first part, the method comprising:

applying an electronic drive signal to at least one of the first electrode and the second electrode; and generating an electrical field with a constant strength between the first part and the second part as the second part is displaced relative to the first part.

2. The electronic drive method according to claim 1, wherein the electronic drive signal is applied using a constant current source.

3. The electronic drive method according to claim 1, wherein the electronic drive signal is a high frequency signal.

4. The electronic drive method according to claim 1, wherein the electronic drive signal is a bi-polar pulse train.

5. The electronic drive method according to claim 1, wherein a magnitude of an applied voltage of the electronic drive signal is reduced over a pulse interval of the signal.

6. The electronic drive method according to claim 5, wherein the electronic drive signal is a high frequency signal.

7. The electronic drive method according to claim 5, wherein the electronic drive signal is a bi-polar pulse train.

8. The electronic drive method according to claim 5, wherein the applied voltage of the electronic drive signal is used to drive a liquid ejector and is reduced as a function of the displacement of a movable member of the liquid ejector.

9. The electronic drive method according to claim 8, wherein the applied voltage of the electronic drive signal varies directly with the distance of the displacement of the moveable member.

10. The electronic drive method according to claim 8, wherein the applied voltage of the electronic drive signal varies indirectly with the distance of the displacement of the moveable member through a function of time.

11. An electronic drive system for an electrostatically actuated device, comprising:

an electrostatically actuated device having a movable member and a stationary member; and a drive signal source that applies an electronic drive signal to one of the movable member and the stationary member such that an electrical field with a constant field strength is generated between the movable member and the stationary member.

12. The electronic drive system according to claim 11, wherein the drive signal source comprises a constant current source.

13. The electronic drive system according to claim 11, wherein the drive signal source comprises a high frequency source.

14. The electronic drive system according to claim 11, wherein the drive signal source comprises a bi-polar voltage source.

15. The electronic drive system according to claim 11, wherein the drive signal source comprises a variable voltage source that reduces an applied voltage of the electronic drive signal over a pulse interval of the signal.

16. The electronic drive system according to claim 15, wherein the variable voltage source is a high frequency source.

17. The electronic drive system according to claim 15, wherein the variable voltage source is bi-polar.

18. The electronic drive system according to claim 15, further comprising:

a position sensor that monitors a displacement of the movable member; and a feedback mechanism connecting the position sensor to the variable voltage source such that the applied voltage of the electronic drive signal is reduced as a function of the displacement of a movable member.

19. The electronic drive system according to claim 15, further comprising:

a timing control communicating with the variable voltage source such that the applied voltage of the electronic drive signal is reduced as a function of time.

* * * * *

UNITED STATES PATENT AND TRADEMARK OFFICE

CERTIFICATE OF CORRECTION

PATENT NO. : 6,419,335 B1
DATED : July 16, 2002
INVENTOR(S) : Gooray et al.

It is certified that error appears in the above-identified patent and that said Letters Patent is hereby corrected as shown below:

Column 1,
After the Title, please insert the following paragraph:

-- GOVERNMENT RIGHTS
This invention was made with Government support under Contract No. DE-AC04-94AL85000 awarded by the U.S. Department of Energy. The Government has certain rights in the invention. --

Signed and Sealed this

Third Day of December, 2002

JAMES E. ROGAN
*Director of the United States Patent and Trademark Office*